US012104373B2

(12) United States Patent
Wang et al.

(10) Patent No.: US 12,104,373 B2
(45) Date of Patent: Oct. 1, 2024

(54) MAGNETIC SUCTION ROOM DIVIDER ASSEMBLY WITH A FOLDABLE STAND MECHANISM

(71) Applicant: A&C Future, Inc, Newport Beach, CA (US)

(72) Inventors: Jiuqi Wang, Tustin, CA (US); Zhuangboyu Zhou, Santa Ana, CA (US); Sichen Li, Irvine, CA (US); Keguan Zou, Irvine, CA (US); Jiayang Qin, Newport Beach, CA (US); Han Qin, Newport Beach, CA (US)

(73) Assignee: A&C Future, Inc

( * ) Notice: Subject to any disclaimer, the term of this patent is extended or adjusted under 35 U.S.C. 154(b) by 0 days.

(21) Appl. No.: 17/862,318

(22) Filed: Jul. 11, 2022

(65) Prior Publication Data

US 2024/0011286 A1 Jan. 11, 2024

(51) Int. Cl.
*E04B 2/74* (2006.01)

(52) U.S. Cl.
CPC ..... *E04B 2/7438* (2013.01); *E04B 2/7425* (2013.01)

(58) Field of Classification Search
CPC ..... E04B 2002/7468; E04B 2002/7474; E04B 2/7401; E04B 2/7405; E04B 2/7416; E04B 2/74; E04B 2/7438; E04B 2/7425; E04B 2/7427
See application file for complete search history.

(56) References Cited

U.S. PATENT DOCUMENTS 3,628,299 A * 12/1971 Nakazawa ..... E04B 1/4107 52/506.06
3,768,222 A * 10/1973 Birum, Jr. ..... A47G 5/00 52/282.2
3,852,927 A * 12/1974 Birum, Jr. ..... E04B 2/789 52/489.1
3,984,949 A * 10/1976 Wahlquist ..... E04B 1/3445 52/143
4,200,254 A * 4/1980 Nelson ..... E04B 2/7405 248/188.8
4,457,117 A * 7/1984 Leiher ..... E04B 2/7416 403/44
4,624,083 A * 11/1986 Diffrient ..... A47B 83/001 52/239
4,862,659 A * 9/1989 Wilson ..... E04F 17/08 174/67
4,870,908 A * 10/1989 Wolters ..... E04B 2/7416 160/37
4,958,671 A * 9/1990 Bove ..... E04B 2/7429 160/351
6,311,441 B1 * 11/2001 Beavers ..... E04F 15/02144 52/239

(Continued)

*Primary Examiner* — Jessica L Laux
(74) *Attorney, Agent, or Firm* — Elizabeth Yang

(57) ABSTRACT

A magnetic suction room divider assembly with a foldable stand mechanism is present, comprising single wall panels connecting with each other via the magnetic suction stopper. The magnetic suction stopper has a thorough hole, and a pin penetrating therein. Preferably, the single wall panel has a foldable stand mechanism on the bottom edge, to control the expand or folded status thereof. The magnetic suction room divider assembly consisting of such constructed single wall panels can save up space and be moved flexibly; and stand on the ground stably.

12 Claims, 7 Drawing Sheets

(56) References Cited

U.S. PATENT DOCUMENTS

| | | | | |
|---|---|---|---|---|
| 2004/0134157 | A1* | 7/2004 | Hoberman | E04B 1/3441 52/80.1 |
| 2010/0051211 | A1* | 3/2010 | Chen | E04B 2/7427 160/135 |

* cited by examiner

MAGNETIC SUCTION ROOM DIVIDER ASSEMBLY WITH A FOLDABLE STAND MECHANISM

FIELD OF THE INVENTION

The present invention relates generally to a room divider assembly and particularly to a room divider assembly with a foldable stand mechanism.

BACKGROUND OF THE INVENTION

A room divider has been broadly applied to some occasions, including medical room, restaurant, and office etc., to provide a separation, wind-shield, and aesthetic function.

There are some maintenance demands for the room divider, including moving, cleaning, and refurbishing, which needs a flexibility and function-ability for room divider's configuration. Accordingly in the art, some detachable and movable room dividers have been produced to meet different requirements. For example, some room divider assemblies are designed to be assembled as multiple modules connecting with each other to stand on the floor to make a division in a room, preferably thereby having support mechanisms installed on the bottom of the room dividers. Furtherly, to facilitate the adaptability and room-saving, some room dividers having rotatable hinges connecting with each other to provide a foldability.

Although the variant designs of room dividers could meet some basic functions demands in the market, there are still drawbacks. A typical drawback of room dividers in the art is that a disassembling is substantively complicated, i.e., requiring external tools driving and time consuming. The second drawback is that the foldability and portability thereof are not enough efficient due to some bottom support stand (like tripod) that has taken up rooms and been moved cumbersomely. An additional drawback lies in that almost all the room divider assembly in the art can't stand by stably holding a pre-set angle between the two connecting modules, because the connecting or locking mechanism between two pieces has only sustained stable with a straight angle.

Therefore, a demand to facilitate the room divider assembly for different complicated occasions is proposed, especially to provide a stability and adaptability in a narrow room. Thus, the present invention has been proposed to solve an urgent need for enhancing the mobility and flexibility of the room divider assembly and pieces thereof.

SUMMARY OF THE INVENTION

This present invention improves the drawbacks of those existing room divider designs. It makes the individual room divider modules have stands stably that can be quickly unfolded and retracted to reduce room divider storage space. At the same time, multiple room divider modules can be put together by the magnetic suction mechanism, and at the same time can be bent at a certain angle like a normal room divider to adapt to various user environments.

To solve the problem arisen in the background, the inventor has developed a magnetic suction room divider assembly with foldable stand.

Specifically, the present invention has provided:

A magnetic suction room divider assembly with foldable stand, the room divider assembly comprising:

Multiple single wall panels being connected with each other; and a locking mechanism to connect the two adjacent single wall panels, the lock mechanism having a magnetic suction stopper with a thorough hole and a pin penetrating therein;

wherein, the single wall panel has a stand mechanism on a bottom edge thereof, having a button in a slot, controlling an expand or folded status of multiple stand legs of the stand mechanism.

In another aspect, wherein the single wall panel has a groove on each side edge thereof, and the magnetic suction stopper is secured in the groove by the pin.

In another aspect, wherein the button is linked to a tongue with a triangle protrusion.

In another aspect, wherein the tongue is attached to the surface of two brackets included in the stand mechanism, and the brackets are located opposite horizontally.

In another aspect, wherein each bracket has protruded rod longtitudedly at the distal end, and the rod is carried by the proximal end of an elongated coil spring.

In another aspect, wherein the distal end of the spring is against with an internal side of the bottom edge of the single wall panel.

In another aspect, wherein the bracket has a concaved rail.

In another aspect, wherein the bracket further has a pinion along the margin of the concave rails, and accordingly the stand leg has a rack engaged to the pinion.

In another aspect, wherein the button is pressed once to expand the stand legs, and pressed again to fold the stand legs.

In another aspect, when the button is pressed once, the tongue pushes to drive the brackets to move laterally until the brackets retains the tongue, triggering the stand legs to expand.

In another aspect, when the button is pressed twice, the spring exerts reaction force until the tongue is reset, triggering the stand legs to fold.

In another aspect, wherein the stand legs are expanded to an extension at a 90° angle.

The system and method of operation of the embodiments disclosed herein, however, together with additional objectives and advantages thereof, will be best understood from the following description of specific, exemplary embodiments when read in connection with the accompanying drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

Figure 1A:
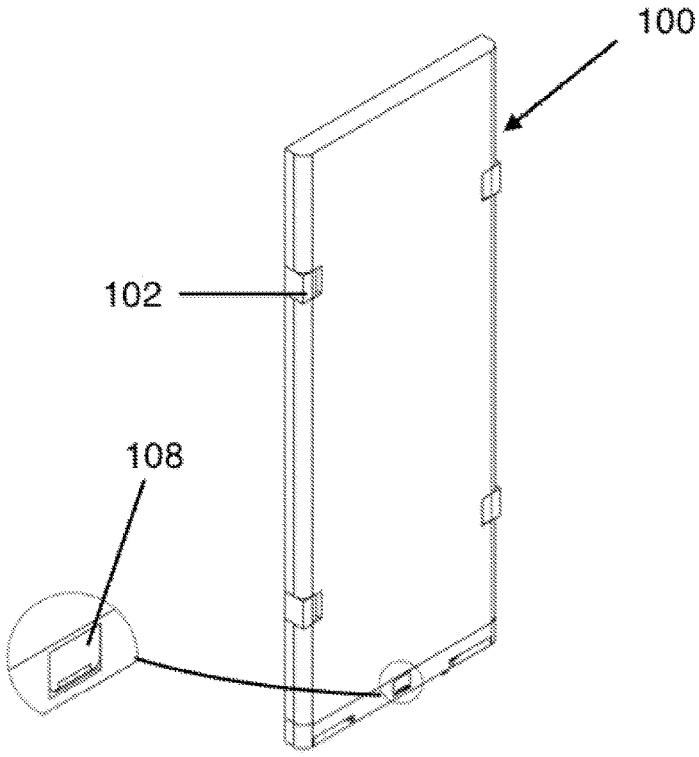
FIG. 1A illustrates a front view of a single wall panel of a room divider assembly, with a folded stand, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. § 112.

A typical magnetic suction room divider assembly with foldable stand mechanism presented in this invention, comprises more than one single wall panel with a foldable stand mechanism, and those wall panels are connected with each other by a locking mechanism to establish a room separation. Specially, the after-established room divider assembly can stand stably upon the expand/unfolded stands or be moveable flexibly upon the retracted/folded stands. In addition, the connected single wall panels of the room divider assembly can be locked stably at a certain angle without any swings via a magnetic suction mechanism.

Figure 1B:
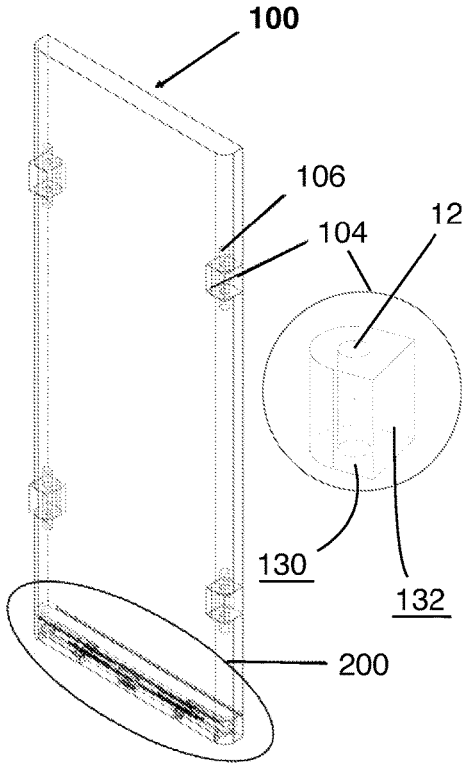
FIG. 1B illustrates a rear view of a single wall panel of the room divider assembly, with a folded stand, in accordance with an embodiment of the present invention.

As referenced in FIG. 1A and FIG. 1B, a magnetic suction room divider assembly with foldable stands is provided in an embodiment. As shown at the front and rear perspective view of the room divider assembly, a single wall panel 100, which is the basic construction units of the present room divider assembly, has a layered panel, shaped as a rectangle or square, preferably rectangle in the embodiment. The single wall panel 100 has at least two grooves 102 at each side edge, and a foldable stand mechanism 200 at the bottom edge, which control the expand or folded status of some stand legs (folded status in FIG. 1A and FIG. 1B). Accordingly, a magnetic suction stopper 104 with a through hole 122 has been mounted in the groove 102, and a pin 106 has penetrated through the hole 122 to extent to the interior of the singe wall panel, securing the magnetic suction stopper 104 in the groove 102.

In addition, the stand mechanism 200 includes a slot 108 located in the middle at the bottom edge of the single wall panel 100, shown in the front view in FIG. 1A. Preferably, a button 112 has been installed in the slot 108, which is a switch to control the open/closed status of the stand mechanism 200. The button 112 is rest upon the closed status of the stand mechanism 200. When pushing the button 112 upon the closed stand mechanism 200, the button 112 will be secured in an active location in the slot 108, meanwhile the stand mechanism 200 will open the stand legs to support the single wall panel. Oppositely, to fold the expand stand legs, a user pushes the active button 112, and the button 112 will be release back to the rest status. The button 112 is pressed once to expand the stand legs, and pressed again to fold the stand legs.

When a user is operating the room divider assembly, the two adjacent single wall panels have the magnetic suction stopper and pin thereof installed in the right location, respectively. The suction force between the magnetic suction stopper retains the adjacent single wall panels to lock with each other in a flexible way. Such a magnetic suction mechanism facilitates the installment of the assembly, which can be snapped rapidly and flexibly without any screws or fasteners driving. In addition, when the room divider assembly needs to be dissembled, a user may detach the adjacent single wall panels rapidly without any tools, or rotate a single wall panel to pile up itself over the adjacent panel thereof.

Figure 2A:
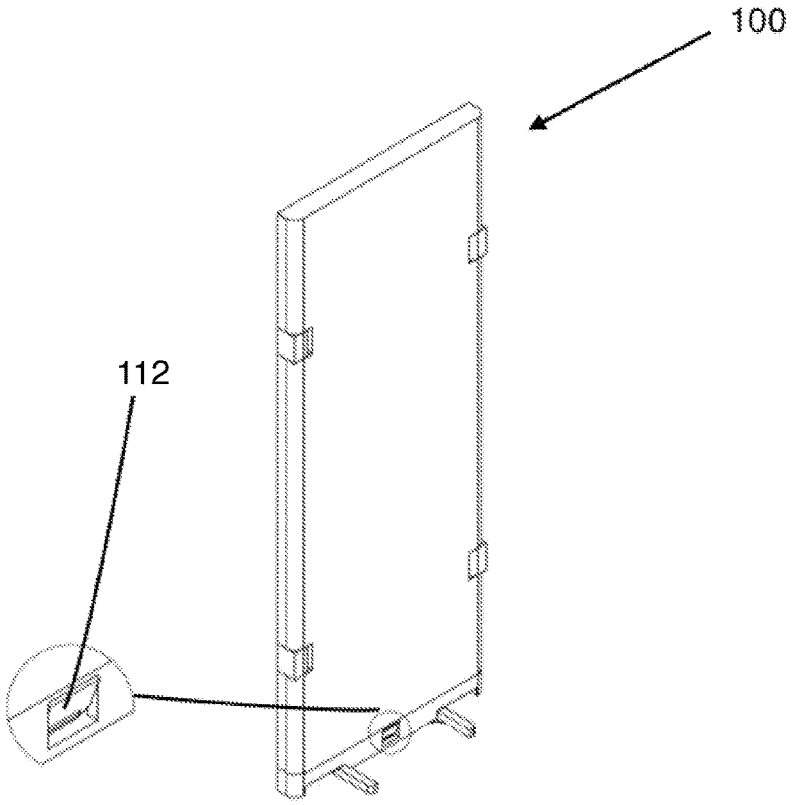
FIG. 2A illustrates a front view of a single wall panel of a room divider assembly, with an expanded stand, in accordance with an embodiment of the present invention.
Figure 2B:
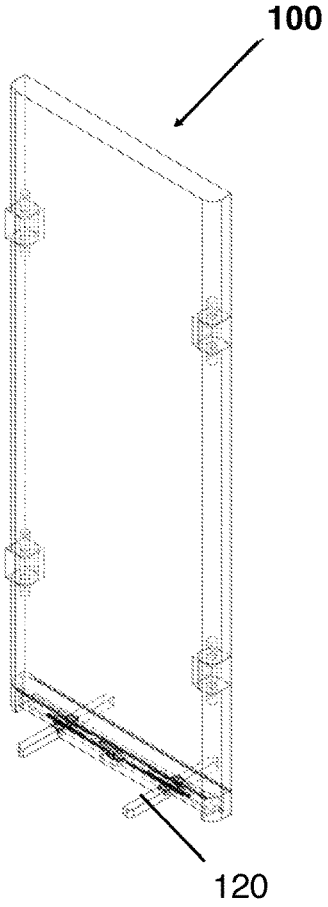
FIG. 2B illustrates a rear view of a single wall panel of a room divider assembly, with an expanded stand, in accordance with an embodiment of the present invention.

FIG. 2A and FIG. 2B has shown another embodiment of the single panel walls with a expand stand leg 120. In the embodiment, the stand mechanism is open and the button at the bottom edge is active. Preferably, upon this status, the stand leg 120 is expanded at a 90° angle to the bottom edge. Preferably, the stand mechanism has two stand legs to open both at front and rear side of the bottom edge, upon the active status. Therefore, the present single wall panels or the room divider assembly can stand in a most stable extension.

Figure 3:
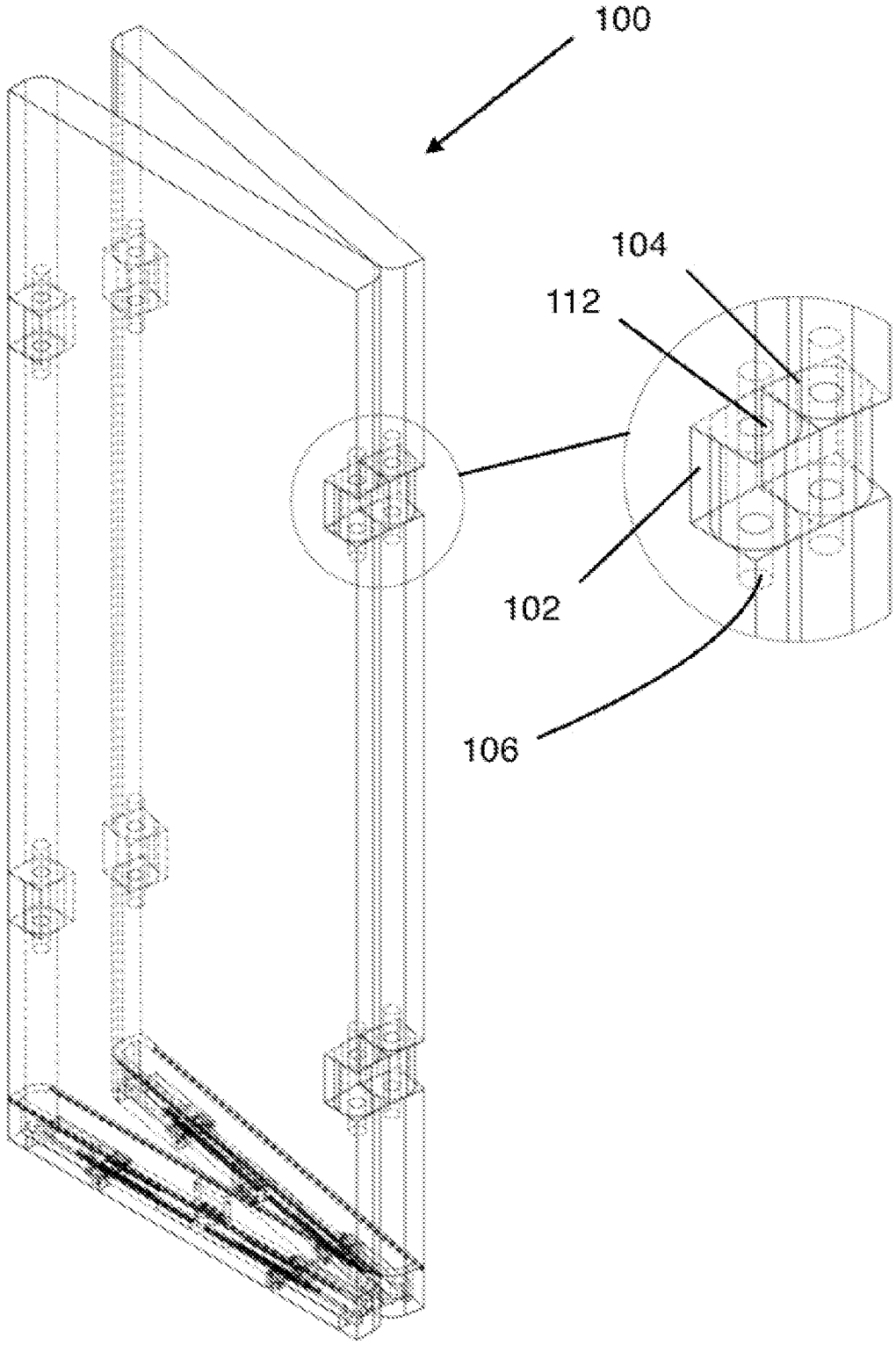
FIG. 3 illustrates a perspective view of a paired of two wall panels, holding a certain angle, in accordance with an embodiment of the present invention.

FIG. 3 illustrates the perspective view of the two adjacent single wall panels upon the locking status of the room divider assembly in another embodiment. When assembling the two single wall panels, a user just installs the magnetic suction stopper 104 in the groove 102. The pin 106 penetrating through the hole 122 retains the magnetic suction stopper 104 in the groove from dislocating. However, meanwhile the pin 106 allows the magnetic suction stopper 104 to rotate on the horizontal level. More inventively, the magnetic suction force allows the rotation of the two adjacent single wall panels easily and flexibly, without any wear-down.

Preferably, to facilitate the rotation of the single wall panel, the transversal surface of the magnetic suction stopper 104 is shaped stadium shape in Geometry, which is a two-dimensional geometric shape constructed of a rectangle with semicircles at a pair of opposite sides 130. In addition, the magnetic suction stopper 104 has a side 132 linked to the pair of opposite sides 130. Such a construction can make the rotation smooth and flexible. Preferably, the side 132 have a strong magnetic properties to attract with side 132 of other adjacent stopper.

Figure 4:
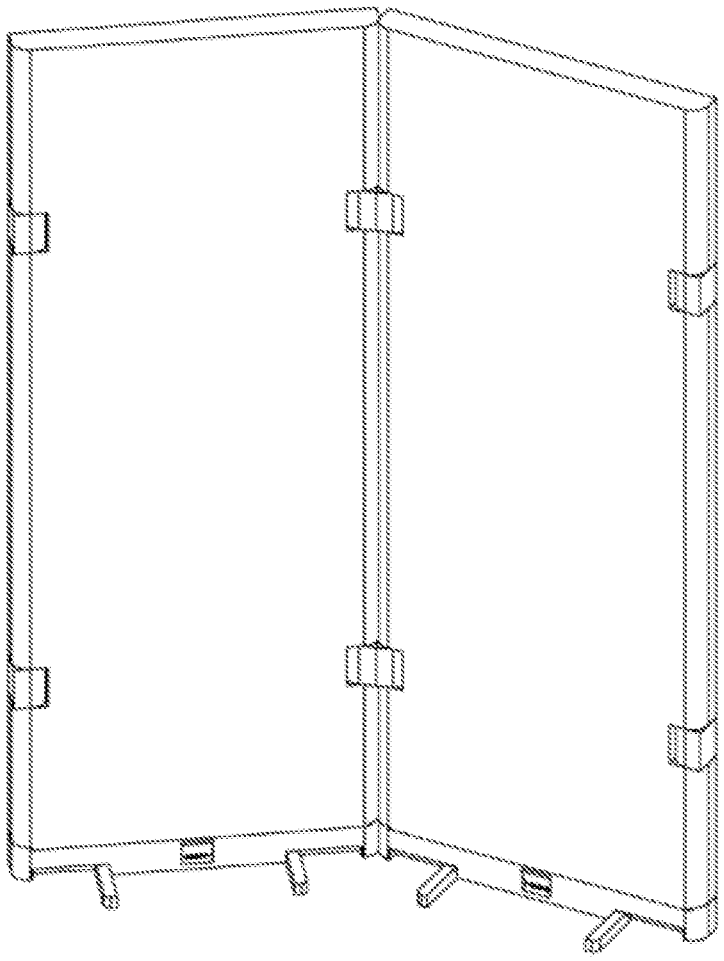
FIG. 4 illustrates a perspective view of a paired of two wall panels with an expand stand, holding a certain angle, in accordance with an embodiment of the present invention.

FIG. 4 illustrates a perspective view of a paired of two single wall panels with an expand stand legs, secured a certain angle in another embodiment of the present invention. As is seen, besides adjusting the two adjacent panels into a flat wall panel, a user also may retain the angle between the two panels at a certain angle, based on some specific needs, for example avoiding too much space taken by an after-established flat wall panel. The stand mechanism at the bottom edge is activated to expand the stand legs to support.

For example, in the embodiment, when there is a demand of saving up the room space or facilitating the delivery of the room divider assembly, a user adjust the single wall panel to make the pair of opposite sides 130 of a single wall panel attach with the sides 130 of the adjacent single wall panel. When there is a demand of separating the room, the two adjacent single wall panel just needs to rotate along the pin to detach with each other, consequently resulting in the detach angle, which is max to 180° angle, assembling a flat wall. Because of the free rotation of the single wall panel along the pin 106, which however is secured in the hole 122 without a vertical dislocation, the adjacent wall panels to be adaptable to secure with a certain angle, expand or pile up based on instant needs.

Figure 5:
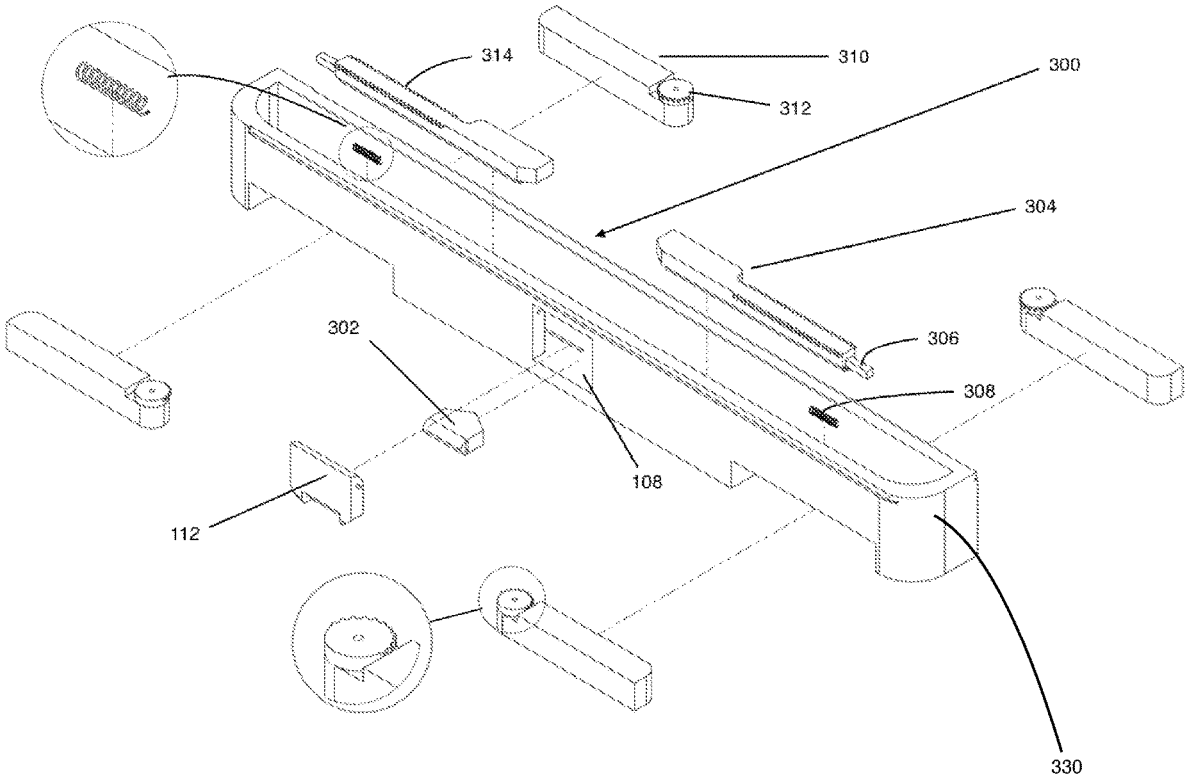
FIG. 5 illustrates an explosive view of a bottom plate of the panels, in accordance with an embodiment of the present invention.

FIG. 5 illustrates an explosive view of a stand mechanism at the bottom edge of the single wall panel, in an embodiment of the present invention. The stand mechanism 300 have a main body 330, and is integrated on the bottom edge of the single wall panel. A slot 108 is included therein, located in the middle of the bottom edge. A button 112 linked to a tongue 302, is installed in the slot. Preferably, the tongue shaped with a triangle protrusion, is inserted into the internal space of the stand mechanism 300, attaching to two brackets 304, which are installed in a line oppositely. Preferably, to make the attachment between tongue and two brackets 304 more tight and adaptable, the engaging surface of the two brackets 304 is shaped with a certain angle to be engaged with the tongue tightly. In the embodiment, each bracket 304 has a protruded rod 306 longitudedly at the distal end, and the rod is carried by end of an elongated coil spring 308. Preferably, the bracket 304 has a concaved rail, and the rail has a pinion 314 along the margin of the concaved rail. Accordingly, a stand leg 310 has a matched rack 312 mounted on the distal end thereof, engaged to the pinion 314 on the bracket.

Figure 6:
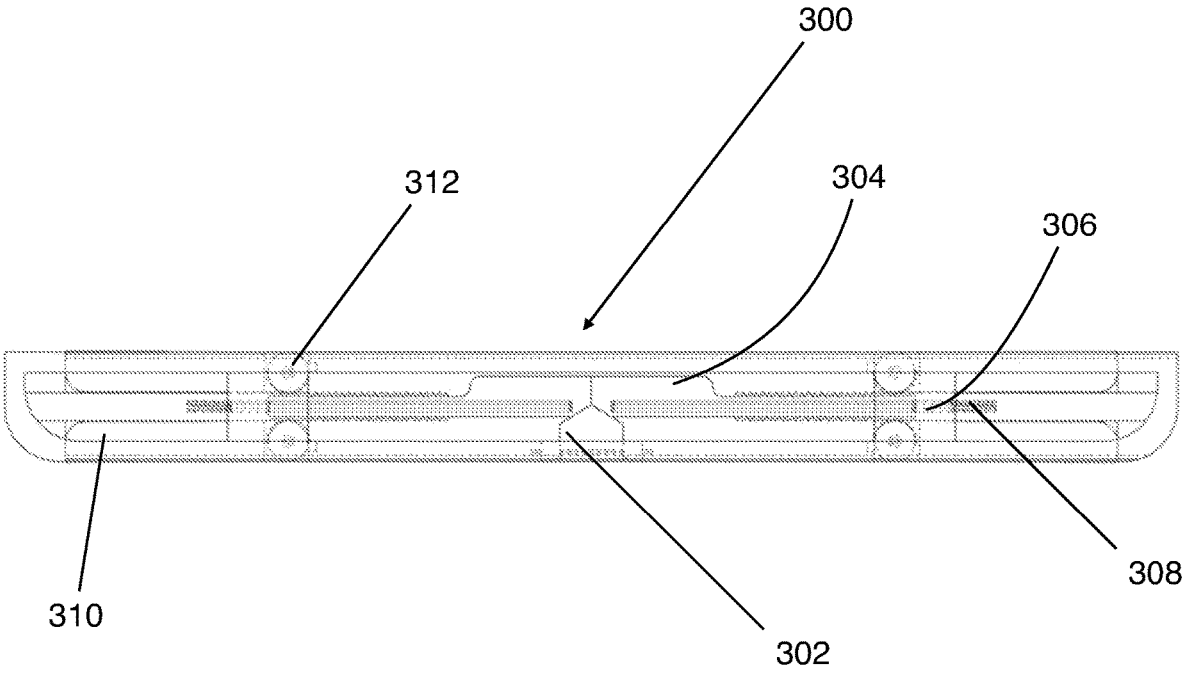
FIG. 6 illustrates an internal view of the bottom plate when the stand is folded, in accordance with an embodiment of the present invention.

FIG. 6 illustrates an internal view of the stand mechanism when the stand leg is folded, in an embodiment of the present invention. As is shown, when the stand mechanism 300 on the bottom edge of the single wall panel is on Unactive status, the rod 306 is carried by proximal end of the elongated coil spring 308 portionally, and the distal end of the elongate coil spring 308 is against with an internal side of the main body 330. The button 112 in the slot is rest, and accordingly the linked tongue 302 just contacts with the shaped surface of the two brackets 304, without applying any force thereto. In addition, the rack 312 on the stand leg 310 is located on the distal end of the pinion 314. In sum, a folded status of the stand mechanism 300 applies no enforcement internally.

Figure 7:
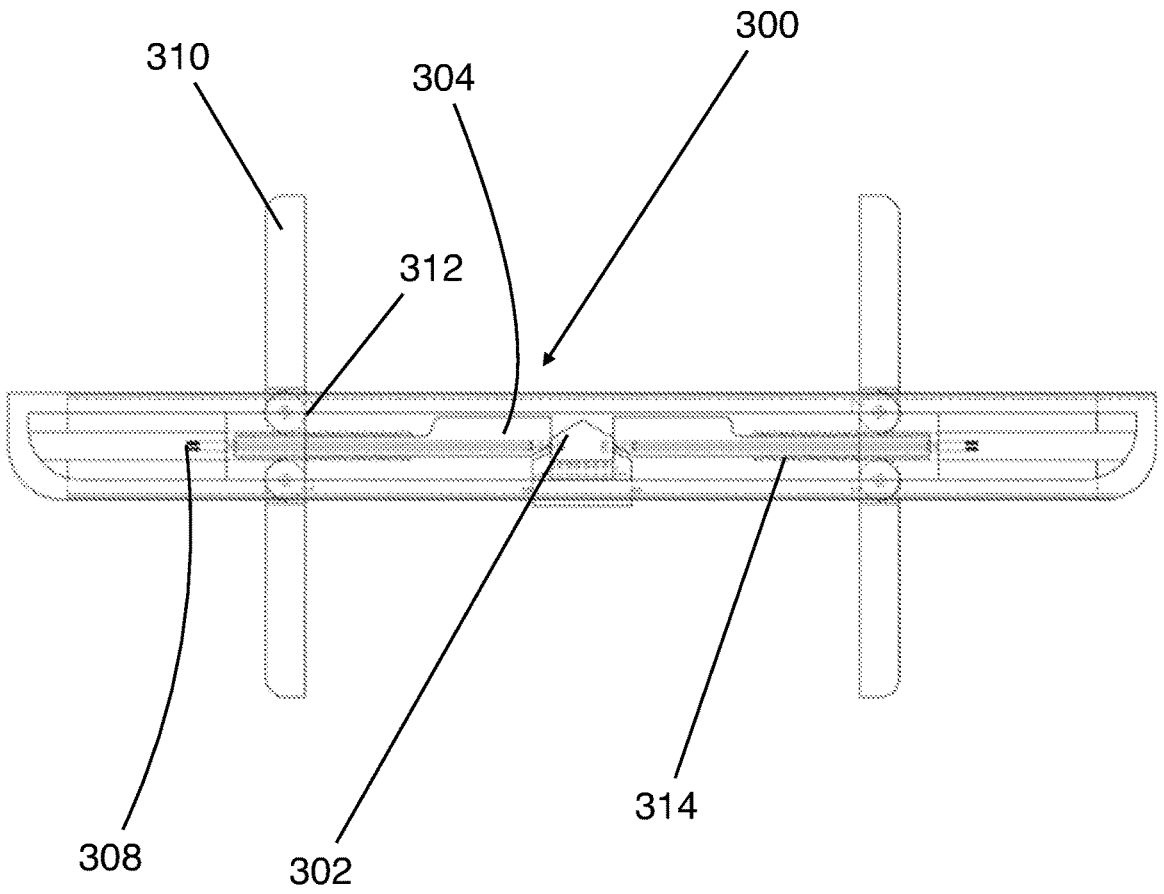
FIG. 7 illustrates an internal view of the bottom plate when the stand is expanded, in accordance with an embodiment of the present invention.

FIG. 7 illustrates a perspective view of the stand mechanism 300 when the stand leg is expanded, in another embodiment of the present invention. To activate the stand mechanism 300, a user just needs to push the button in the slot, driving the linked tongue 302 to push against the two brackets 304 to move laterally. Meanwhile, the coil spring 308 carrying the rod 306 is pressed against at the internal side of the bottom edge. The lateral motion of the bracket 304 causes meshed the rack 312 on the pinion 314 to move at an opposite direction thereof. With the move of the rack 312 on the pinion, the stand leg 310 begins to expand.

When the tongue is moved to a limit location, the shaped surface of the bracket 304 is detached completely to the triangle shaped surface of the tongue 302, and meanwhile, the end surface of the tongue 302 is engaged with the pair of opposite side surface. Since then, the compressed spring 308 has not been pushed against and begun to release to stretch, exerting a reaction force to the bracket 304, and then consequently securing the tongue 302 in a stable location. As a result, the bracket 304 is fixed. Until then, the stand leg 304 expands to an extension at a 90° angle.

When needing to fold the stand legs 310, a user just pushes the button 112, let the tongue 302 back to attach the shaped surface of the bracket, the reaction force from the coil spring 308 drives the bracket back to the original position upon the Rest status. Until then, Reset has been done.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

We claim:

1. A magnetic suction room divider assembly with foldable stand mechanism, the room divider assembly comprising:

multiple single wall panels being connected with each other; and a plurality of magnetic suction stoppers to connect two adjacent single wall panels, the plurality of magnetic suction stoppers has a thorough hole and a pin penetrating therein, wherein, each of the multiple single wall panels has a plurality of stand legs on a bottom edge, the bottom edge having a main body and a button in a slot to control an expand status or a folded status of the plurality of stand legs, and each of the plurality of magnetic suction stoppers has a side linked to a pair of opposite sides, and the side is a strong magnet for attracting with the side of an adjacent magnetic suction stopper.

2. The room divider assembly of claim 1, wherein each of the multiple single wall panels further has at least two grooves on each side edge thereof, and the plurality of magnetic suction stoppers is secured in the at least two grooves by the pin.

3. The room divider assembly of claim 1, wherein the button is linked to a tongue with triangle protrusion.

4. The room divider assembly of claim 3, wherein the tongue is attached to a surface of two brackets included in the bottom edge, and the brackets are located opposite horizontally.

5. The room divider assembly of claim 1, further comprising two brackets, wherein each of the brackets has protruded a rod longtitudedly at a distal end, and the rod is carried by a proximal end of an elongated coil spring.

6. The room divider assembly of claim 5, wherein a distal end of the elongated coil spring is against with an internal side of the main body.

7. The room divider assembly of claim 1, further comprising two brackets, wherein each of the brackets has a concaved rail.

8. The room divider assembly of claim 7, wherein each of the brackets further has a pinion along a margin of the concave rail, and accordingly the plurality of stand legs has a rack engaged to the pinion.

9. The room divider assembly of claim 1, wherein the button is pressed once to expand the plurality of stand legs, and pressed twice to fold the plurality of stand legs.

10. The room divider assembly of claim 9, when the button is pressed once, a tongue pushes to drive brackets to move laterally until the brackets retains the tongue, triggering the plurality of stand legs to expand.

11. The room divider assembly of claim 9, when the button is pressed twice, a spring exerts reaction force until a tongue is reset, triggering the plurality of stand legs to fold.

12. The room divider assembly of claim 9, wherein the plurality of stand legs is expanded to an extension at a 90° angle.

* * * * *